US007946683B2

(12) United States Patent
Gao et al.

(10) Patent No.: US 7,946,683 B2
(45) Date of Patent: May 24, 2011

(54) PRINTING SYSTEM PARTICLE REMOVAL DEVICE AND METHOD

(75) Inventors: Zhanjun Gao, Rochester, NY (US); Jinquan Xu, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 948 days.

(21) Appl. No.: 11/780,522

(22) Filed: Jul. 20, 2007

(65) Prior Publication Data

US 2009/0021567 A1 Jan. 22, 2009

(51) Int. Cl.
*B41J 2/14* (2006.01)

(52) U.S. Cl. ..... 347/48

(58) Field of Classification Search ..... 347/46, 347/48, 54, 89, 90
See application file for complete search history.

(56) References Cited

U.S. PATENT DOCUMENTS

| | | | | |
|---|---|---|---|---|
| 4,697,195 | A * | 9/1987 | Quate et al. | 347/46 |
| 4,745,419 | A * | 5/1988 | Quate et al. | 347/46 |
| 4,748,461 | A * | 5/1988 | Elrod | 347/46 |
| 4,959,674 | A * | 9/1990 | Khri-Yakub et al. | 347/46 |
| 5,543,827 | A | 8/1996 | VanSteenkiste et al. | |
| 6,312,121 | B1 * | 11/2001 | Smith et al. | 347/96 |
| 6,503,454 | B1 * | 1/2003 | Hadimioglu et al. | 422/100 |
| 6,861,034 | B1 * | 3/2005 | Elrod et al. | 422/100 |
| 6,964,470 | B2 | 11/2005 | Kagami | |
| 7,150,512 | B2 | 12/2006 | Levin et al. | |
| 7,207,651 | B2 * | 4/2007 | Amemiya | 347/46 |
| 7,426,866 | B2 * | 9/2008 | Van Tuyl et al. | 73/597 |

* cited by examiner

*Primary Examiner* — Anh T. N. Vo
(74) *Attorney, Agent, or Firm* — William R. Zimmerli

(57) ABSTRACT

A printing system includes a liquid source including a liquid with the liquid including particles. An acoustic transducer is associated with the liquid source. A controller is operably associated with the acoustic transducer and is configured to actuate the acoustic transducer to generate a standing sound wave including a nodal point in the liquid such that the particles are caused to move toward the nodal point of the standing sound wave.

14 Claims, 7 Drawing Sheets

PRINTING SYSTEM PARTICLE REMOVAL DEVICE AND METHOD

CROSS REFERENCE TO RELATED APPLICATIONS

Reference is made to commonly-assigned, copending U.S. patent application Ser. No. 11/682,352 filed Mar. 6, 2007 entitled "PRINTING SYSTEM PARTICLE REMOVAL DEVICE AND METHOD."

FIELD OF THE INVENTION

The present invention relates, generally, to the removal of particles from liquid and, in particular, to the removal of particles from liquids used in printing systems.

BACKGROUND OF THE INVENTION

Ink jet printing has become recognized as a prominent contender in the digitally controlled, electronic printing arena because of, e.g., its non-impact, low noise characteristics and system simplicity. For these reasons, ink jet printers have achieved commercial success for home and office use and other areas.

Traditionally, digitally controlled inkjet printing capability is accomplished by one of two technologies. Both technologies feed ink through channels formed in a printhead. Each channel includes a nozzle from which droplets of ink are selectively extruded and deposited upon a medium.

The first technology, commonly referred to as "drop-on-demand" ink jet printing, provides ink droplets for impact upon a recording surface using a pressurization actuator (thermal, piezoelectric, etc.). Selective activation of the actuator causes the formation and ejection of a flying ink droplet that crosses the space between the printhead and the print media and strikes the print media. The formation of printed images is achieved by controlling the individual formation of ink droplets, as is required to create the desired image. Typically, a slight negative pressure within each channel keeps the ink from inadvertently escaping through the nozzle, and also forms a slightly concave meniscus at the nozzle, thus helping to keep the nozzle clean.

Conventional "drop-on-demand" ink jet printers utilize a pressurization actuator to produce the ink jet droplet at orifices of a print head. Typically, one of two types of actuators is used including heat actuators and piezoelectric actuators. With heat actuators, a heater, placed at a convenient location, heats the ink causing a quantity of ink to phase change into a gaseous steam bubble that raises the internal ink pressure sufficiently for an ink droplet to be expelled. With piezoelectric actuators, an electric field is applied to a piezoelectric material possessing properties that create a mechanical stress in the material causing an ink droplet to be expelled. The most commonly produced piezoelectric materials are ceramics, such as lead zirconate titanate, barium titanate, lead titanate, and lead metaniobate.

The second technology, commonly referred to as "continuous stream" or "continuous" ink jet printing, uses a pressurized ink source which produces a continuous stream of ink droplets. Conventional continuous ink jet printers utilize electrostatic charging devices that are placed close to the point where a filament of working fluid breaks into individual ink droplets. The ink droplets are electrically charged and then directed to an appropriate location by deflection electrodes having a large potential difference. When no print is desired, the ink droplets are deflected into an ink capturing mechanism (catcher, interceptor, gutter, etc.) and either recycled or disposed of. When a print is desired, the ink droplets are not deflected and allowed to strike a print media. Alternatively, deflected ink droplets may be allowed to strike the print media, while non-deflected ink droplets are collected in the ink capturing mechanism.

Regardless of the type of inkjet printer technology, it is desirable to keep the ink free of particles that may clog or partially clog the printhead nozzles. In inkjet printing, some micro-sized solid particles present in printing ink. These solid particles may come from dry ink in the system, or conglomeration of sub-micron ink pigments. There are also evidences of growth of bacteria that form particles in the ink. In other cases the origins of these solid particles are unknown. Particles having sizes (in microns) that are comparable to the nozzle size may not pass through nozzles smoothly, causing droplet deflection that adversely affects droplet placement. The particles even can block the nozzles that result in early printhead replacement. This problem is known as a nozzle contamination in inkjet printing. To reduce or even eliminate the contamination issue, a method to decontaminate ink would be useful. Another problem related to particle contamination is that once a printhead is contaminated by the particles, it has to be dismounted and sent back to the manufacturer for refurbishing. This can be expensive from cost and lost production time standpoints.

Even though filters are commonly used in inkjet printhead to remove particles, they are not effective at removing in-situ particles that are formed near the printhead nozzles as dried ink or conglomerations of small particles. These in-situ particles tend to form within the printhead near the nozzles when the printhead is not in service. Furthermore, efforts of removing these particles by recycling the ink through the ink tank with filters are not fully successful since some particles are trapped in the areas where the flow field is dominated by local circulation near the nozzles. In the printing mode, however, these particles may randomly stray away from the local circulation and reach the nozzle, causing nozzle contamination. This issue is particularly severe for continuous inkjet printing where a large amount of ink is normally consumed during a printing operation.

U.S. Pat. No. 7,150,512 discloses a device using a solvent based cleaning fluid to flush the nozzle, drop generator and catcher while the continuous ink jet printing device is not in print mode. The reclaimed ink from the catcher has less debris therefore the recycling rate to deliver the ink is increased due to a lower concentration of debris being present in the reclaimed ink thereby minimizing clogging of the components.

U.S. Pat. No. 6,964,470 discloses a method to prevent adhesion of colorant particles to the tip of an ink guide (or nozzle). When in cleaning mode a piezoelectric device vibrates the ink guide, thereby giving the colorant particles kinetic energy to eject from the surface.

U.S. Pat. No. 5,543,827 discloses an ink jet printhead nozzle when in cleaning mode a piezoelectric device vibrates the nozzle plate to facilitate cleaning solvent to flow in the same direction as gravity. A controller operates not only the valve to allow cleaning fluid to flow but also controls the nozzle plate vibration.

These techniques are not always effective especially when trying to remove particles that are trapped in areas where the fluid flow field is dominated by local circulation, for example, near the nozzle of a printhead. Therefore, it would be useful to have an apparatus and method capable of removing these particles.

SUMMARY OF THE INVENTION

According to one aspect of the invention, a method of operating a printing system includes providing a liquid source of liquid including a liquid, the liquid including particles; providing an acoustic transducer associated with the liquid source; and actuating the acoustic transducer using a controller to generate a standing sound wave including a nodal point in the liquid such that the particles are caused to move toward the nodal point of the standing sound wave.

According to another aspect of the invention, a method of operating a printing system includes providing a liquid source of liquid including a liquid, the liquid including particles; providing a pressure generating mechanism associated with the liquid source; and actuating the pressure generating mechanism using a controller to generate a region of high pressure and a region of low pressure in the liquid that are transparent to the liquid and that cause particles in the liquid to move from the region of high pressure toward the region of low pressure.

According to another aspect of the invention, a printing system includes a liquid source including a liquid with the liquid including particles. An acoustic transducer is associated with the liquid source. A controller is operably associated with the acoustic transducer and is configured to actuate the acoustic transducer to generate a standing sound wave including a nodal point in the liquid such that the particles are caused to move toward the nodal point of the standing sound wave.

BRIEF DESCRIPTION OF THE DRAWINGS

In the detailed description of the preferred embodiments of the invention presented below, reference is made to the accompanying drawings, in which.

DETAILED DESCRIPTION OF THE INVENTION

The present description will be directed in particular to elements forming part of, or cooperating more directly with, apparatus in accordance with the present invention. It is to be understood that elements not specifically shown or described may take various forms well known to those skilled in the art.

The present invention utilizes the standing waves for which the terminologies are explained briefly below.

Figure 1:
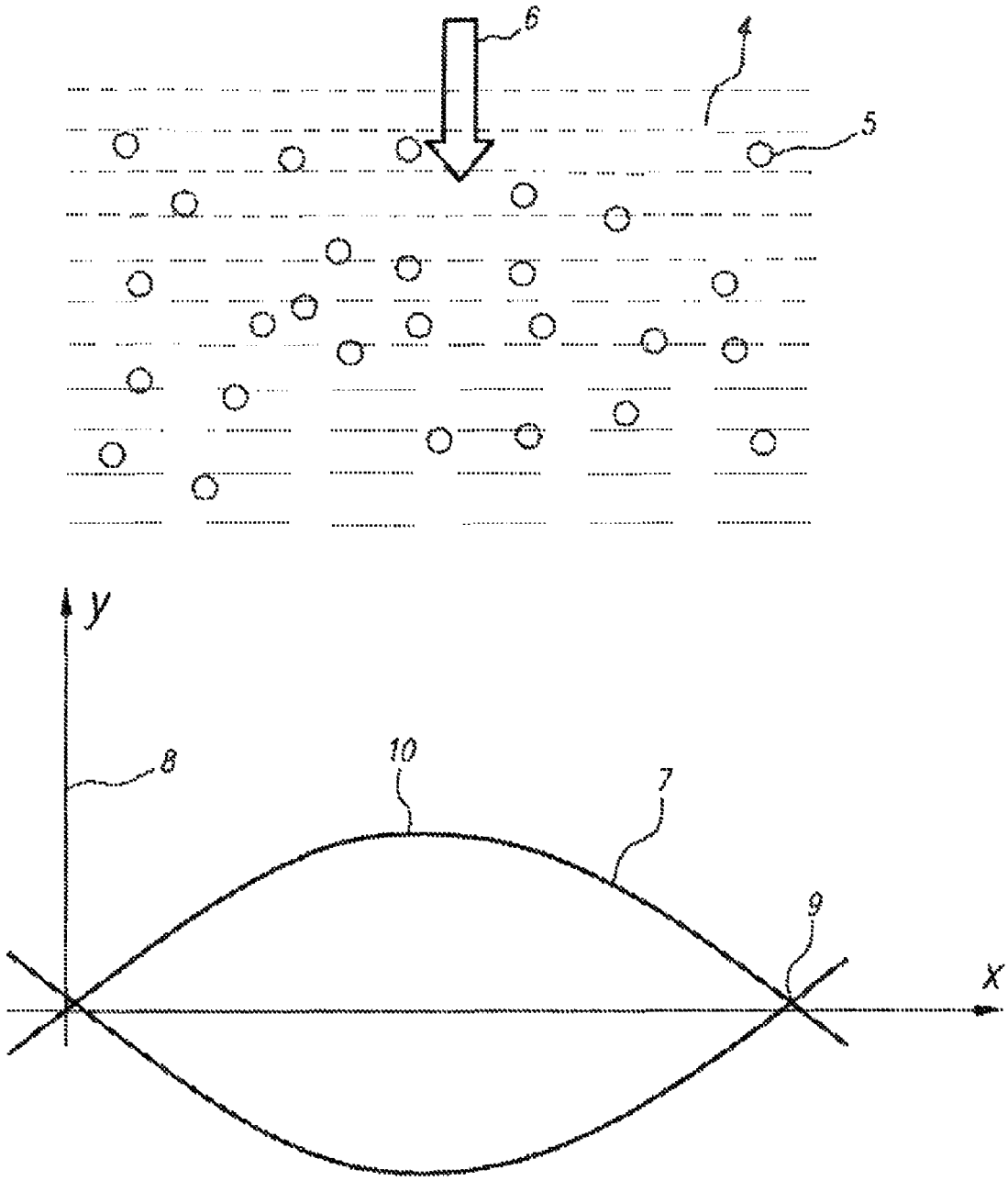
FIG. 1 is a schematic view of a standing wave and a liquid flow containing particles.

Two waves with the same frequency, wavelength, and amplitude traveling in opposite directions will interfere and produce standing waves 7 shown in FIG. 1. Let the harmonic waves be represented by the equations below in the x-y coordinate system 8

$$y_1 = A\mathrm{Sin}\left(\frac{2\pi t}{T} - \frac{2\pi x}{\lambda}\right) \tag{1}$$

and $$y_2 = A\mathrm{Sin}\left(\frac{2\pi t}{T} + \frac{2\pi x}{\lambda}\right) \tag{2}$$

where $y_1$ and $y_2$ describes the displacement to a certain position x at time t. A is the amplitude of the wave, $\lambda$ is the wavelength, and T is the period. Adding the waves and using a trig identity we find $$y = y_1 + y_2 = A\mathrm{Sin}\left(\frac{2\pi t}{T}\right)\mathrm{Cos}\left(\frac{2\pi x}{\lambda}\right) \tag{3}$$

This is a standing wave—a stationary vibration pattern. It has nodes 9—points where the medium doesn't move, and antinodes 10—points where the motion is a maximum.

The above equation can also be written in terms of pressure, i.e., $$p = p_0\mathrm{Cos}\left(\frac{2\pi t}{T}\right)\mathrm{Sin}\left(\frac{2\pi x}{\lambda}\right) \tag{4}$$

where $p_0$ is the pressure amplitude.

When a liquid flow 4 containing particles 5 passes the standing wave 7 in the flow direction 6, the standing pressure wave creates a force on the particles 5 in the x direction, $F_x$, given by Yosioka and Kawasima (Acoustic radiation pressure on a compressible sphere, Acoustica, 5, 167-173 (1955))

$$F_x = -\left(\frac{\pi p_0^2 V_1 \beta_2}{2\lambda}\right)\left(\frac{5\rho_1 - 2\rho_2}{2\rho_1 + \rho_2} - \frac{\beta_1}{\beta_2}\right)\mathrm{Sin}\left(\frac{2\pi x}{\lambda}\right) \tag{5}$$

where $\rho$ and $\beta$ are density and compressibility, $V_1$ is the volume fraction of particle. The subscripts 1 and 2 denote quantities associated with the particles 5 and the liquid flow 4, respectively.

It is easy to see that the force exerted on a particle by the standing wave depends on the strength and frequency of the acoustic wave, as well as the volume fraction of the particles. Furthermore, the magnitude and direction of the force depends on the relative elastic properties of the particle and the liquid flow 4 that carries the particles 5. For example, the sign of $$\phi = \frac{5\rho_1 - 2\rho_2}{2\rho_1 + \rho_2} - \frac{\beta_1}{\beta_2}$$

determines the direction of the force. When $\phi$ is positive, the force $F_x$ is negative. The particles will be dragged to pressure node (minimum pressure). When $\phi$ is negative, the force $F_x$ is positive. The particles will then be forced to pressure antinode (maximum pressure). For particles with $\phi=0$, the force $F_x$ is zero. Therefore, these particles will not have x-direction movement.

Figure 2A:
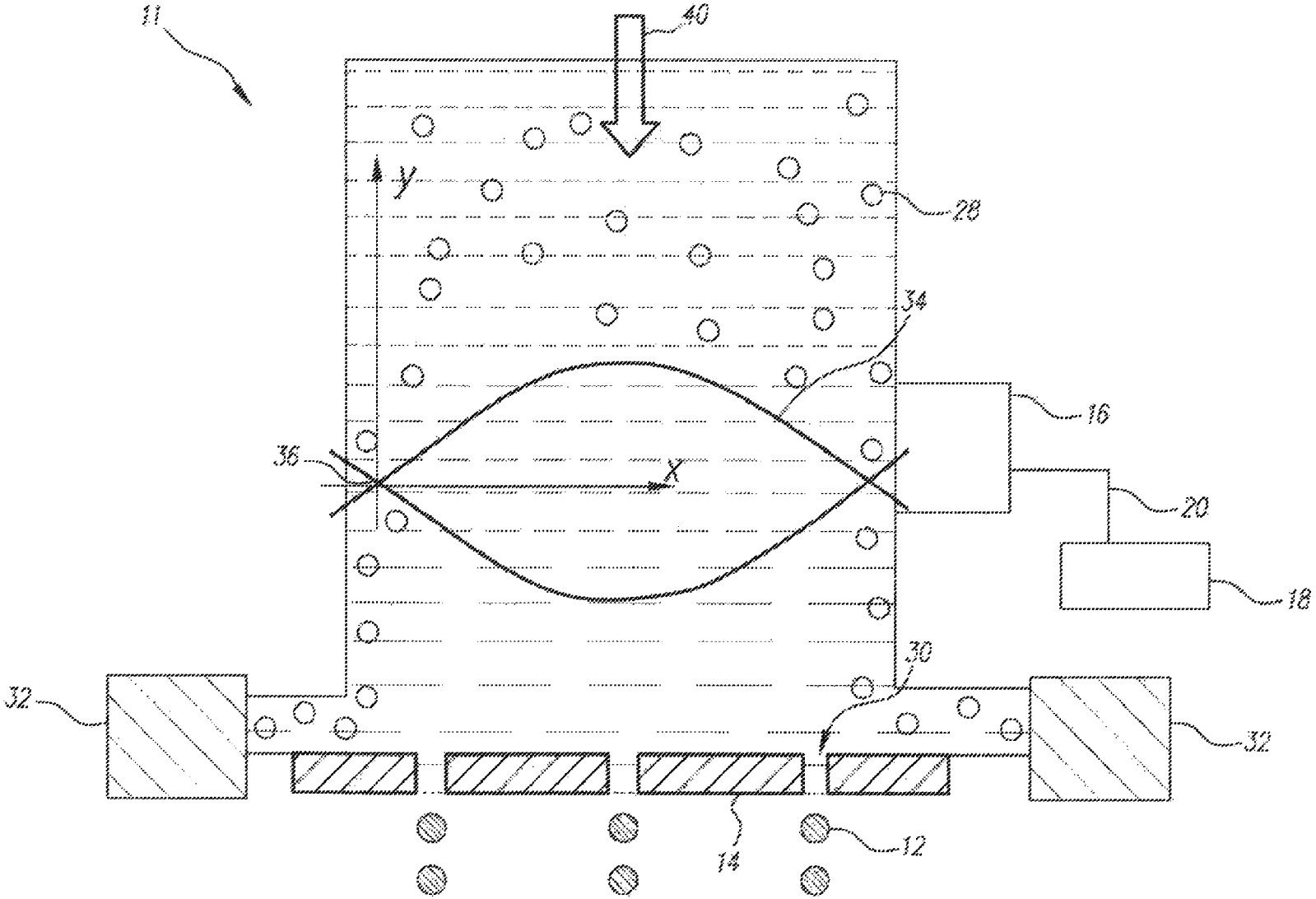
FIG. 2A is a schematic view of a printing system incorporating an example embodiment of a particle removal device.

Referring to FIG. 2A, an inkjet printhead 11 is shown, ejecting liquid droplets 12 through a nozzle plate 14, onto a selected location on a receiver (not shown). The liquid droplets 12 generally comprise a recording agent, such as a dye or pigment, and a large amount of solvent. The solvent, or carrier liquid, typically is made up of water, an organic material such as a monohydric alcohol, a polyhydric alcohol or mixtures thereof. The nozzle plate 14 is representative of nozzle plates made by any of several common commercially used methods and may be composed of any of several materials, for example, electroplated nickel or gold.

In the present invention, the printhead is attached to an acoustic resonator 16, operable for generating a standing wave 34 along the direction transverse to the liquid flow direction 40. The acoustic resonator 16 may be, for example, a well-known commercially available resonator such as a magnetic resonator and a piezoelectric resonator. The acoustic resonator 16 is connected in electrical communication with and is electrically controlled by a controller 18 over a conductive path 20. The standing wave 34 has a pressure profile, which appears to "stand" still in time. The pressure profile in a standing wave varies from areas of high pressure to areas of low pressure. As the ink flow passes through the pressure wave before reaching the ink nozzle plate, the pressure gradients due to the standing wave 34 are expected to give rise to particle motion transverse to main ink flow toward the pressure nodes of the standing wave, which corresponds to minimum pressure points. Therefore, the particles migrate away from the nozzle with the cycled ink toward the ink recycling mechanism 32. These particles are then filtered out from the printhead. The ink recycling mechanism 32 may be a flow pass that leads the ink back to the ink tank with filtering systems. It may contain a particle collection mechanism that consists of porous material that traps the particles. The embodiment shown in FIG. 2A is suitable for ink system with a positive $\phi$ value. The x-direction force on the particle, $F_x$ in this case is negative. The particles are forced to move along the pressure nodes 36 so that they are away from the printing nozzles.

The pressure wave profile can be adjusted to change the pressure node and antinode locations. In the example embodiment shown in FIG. 2B, the pressure node 37 is located in the center of the printhead, while the pressure antinodes 35 (maximum pressure location) are located near the wall of the printhead, aligned with the ink recycling mechanism 32. This embodiment is suitable for ink system with a negative $\phi$ value. The x-direction force on the particle, $F_x$ in this case is positive. The particles are forced to move along the pressure antinodes 35 so that they are away from the printing nozzles.

Figure 2B:
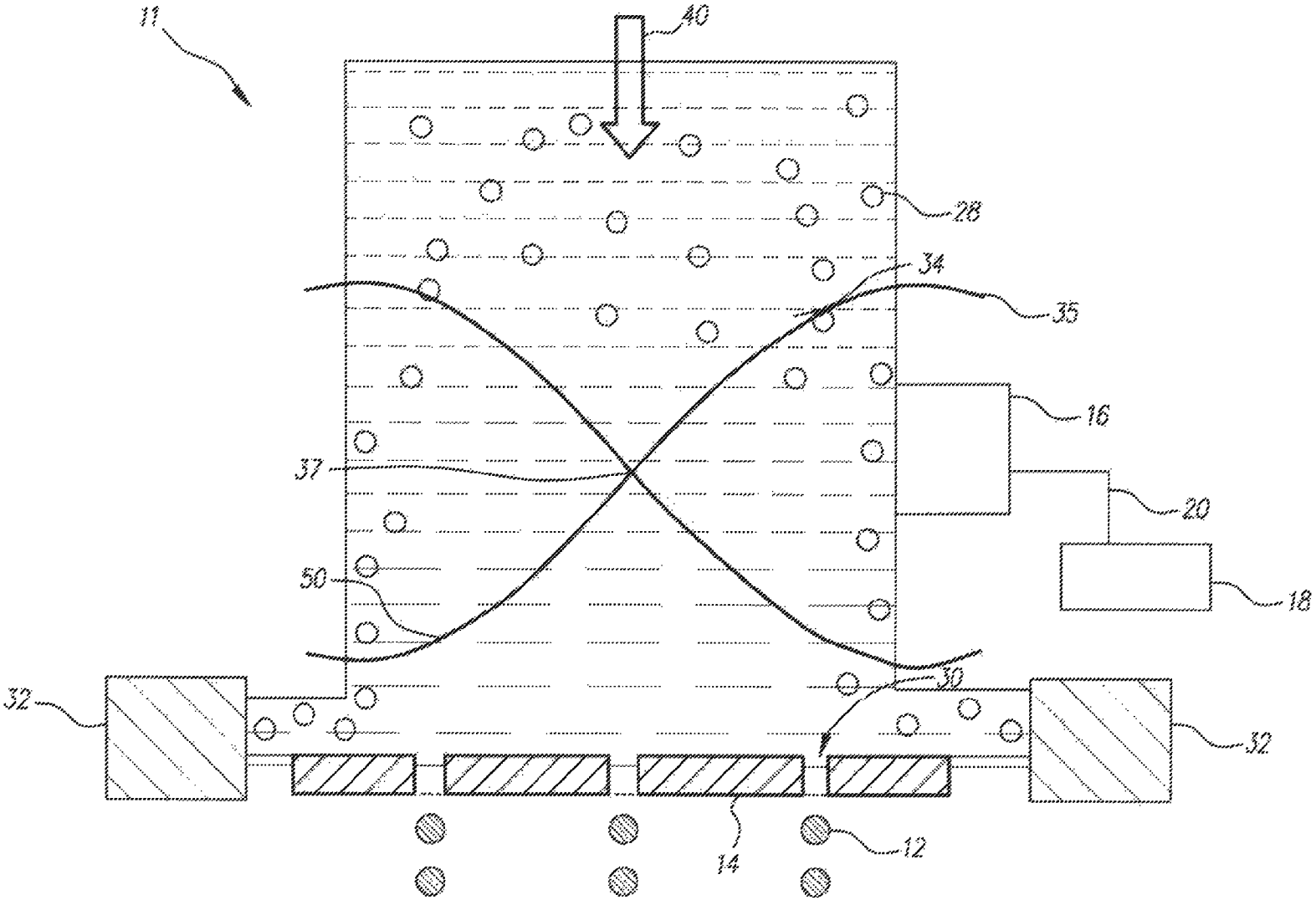
FIG. 2B is a schematic view of a printing system incorporating another example embodiment of a particle removal device.
Figure 2C:
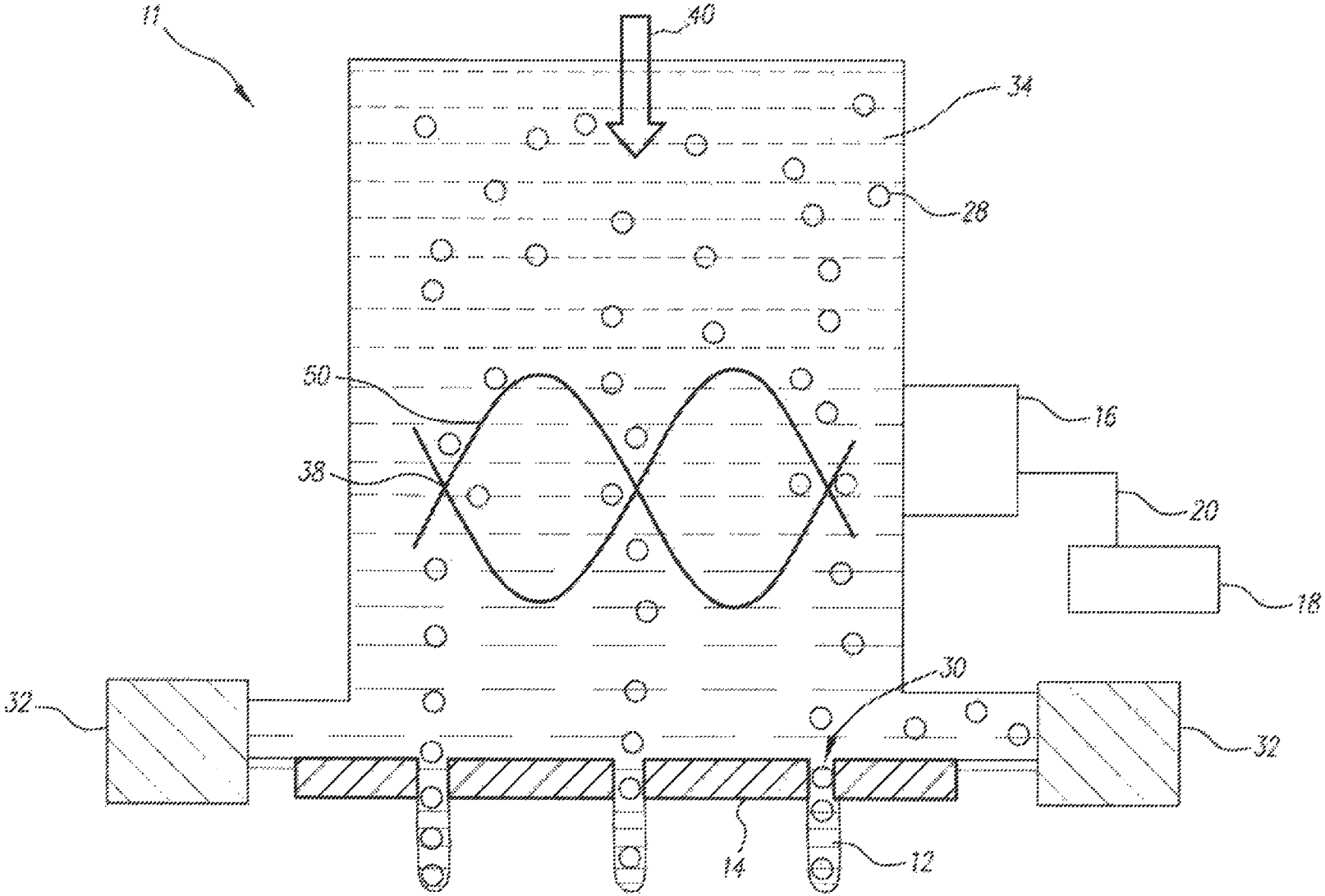
FIG. 2C is a schematic view of a printing system incorporating yet another example embodiment of a particle removal device.

FIG. 2C is another embodiment where the standing wave is designed with the pressure nodes 38 aligned with the nozzle openings 30. This embodiment is suitable for ink system with a positive $\phi$ value. The particles are forced to pass through the nozzle openings 30 during the maintenance mode.

The embodiments shown in FIGS. 2A and 2B typically are applied to the nozzle plate, guiding the undesired particles away from the printing area of the nozzle plate. On the other hand, the embodiment in FIG. 2C is focused on control of an individual nozzle. The frequency, wavelength and node location of the standing wave are critical design parameters for this invention to achieve its desired purpose. For the embodiment in FIGS. 2A and 2B, the half wavelength needs to be about the same as the printing width of the nozzle plate (in the order of inches). For the embodiment in FIG. 2C, the half wavelength is much smaller and should be about the same as the distance between the two adjacent nozzles (in the order of micro-meters).

Figure 3A:
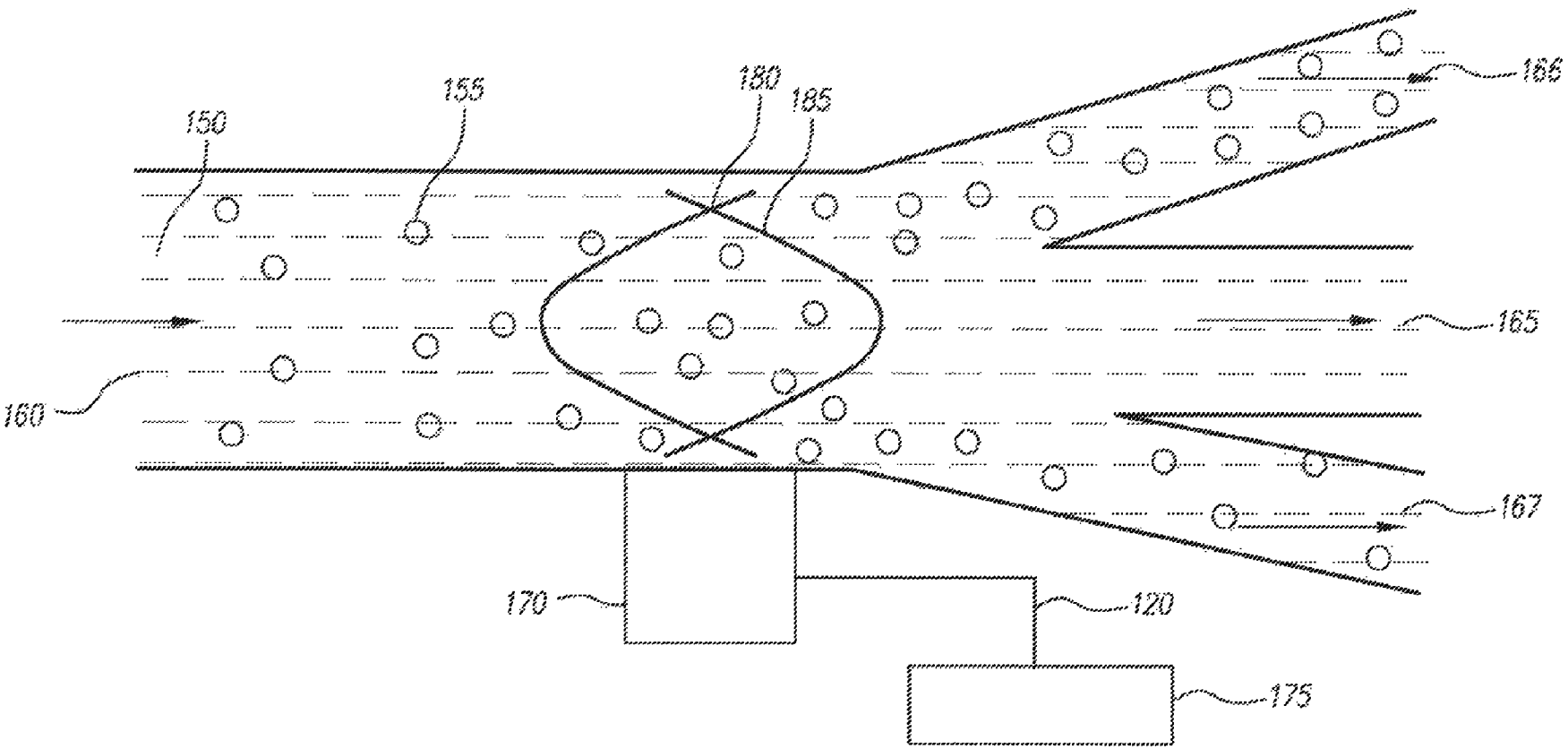
FIG. 3A is a schematic view of an embodiment of a stand-alone particle removal device.

FIG. 3A is an embodiment of a stand-alone particle removal apparatus. A liquid source 150 containing particles 155 is provided through an inlet 160 to outlets 165, 166 and 167. An acoustic resonator 170 is controlled by a controller 175 to form a standing wave 185 with nodes 180 along the direction transverse to the liquid flow direction. The standing wave causes the particles 155 with positive $\phi$ value to move toward the nodes 180. Therefore, the particles 155 follow the liquid flow into outlet 166 and 167, and are removed from the liquid flow in outlet 165.

Figure 3B:
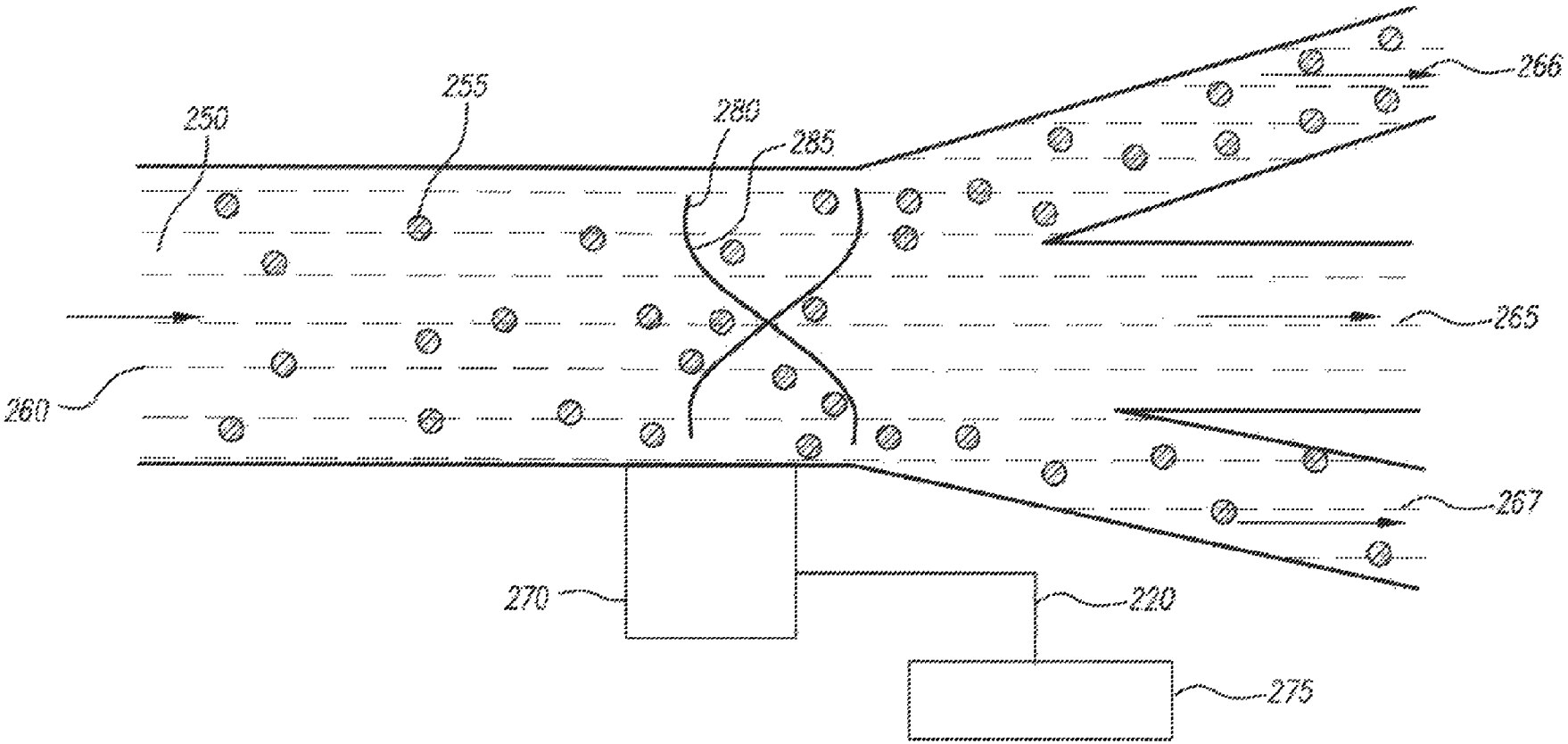
FIG. 3B is a schematic view of another embodiment of a stand-alone particle removal device.

FIG. 3B is an embodiment of a stand-alone particle cleaning apparatus. A liquid source 250 containing particles 255 is provided through an inlet 260 to outlets 265, 266 and 267. An acoustic resonator 270 is controlled by a controller 275 to form a standing wave 285 with antinodes 280 along the direction transverse to the liquid flow direction. The standing wave causes the particles 255 with negative $\phi$ value to move toward the antinodes 280. Therefore, the particles 255 follow the liquid flow into outlet 266 and 267, and are removed from the liquid flow in outlet 265.

Figure 4:
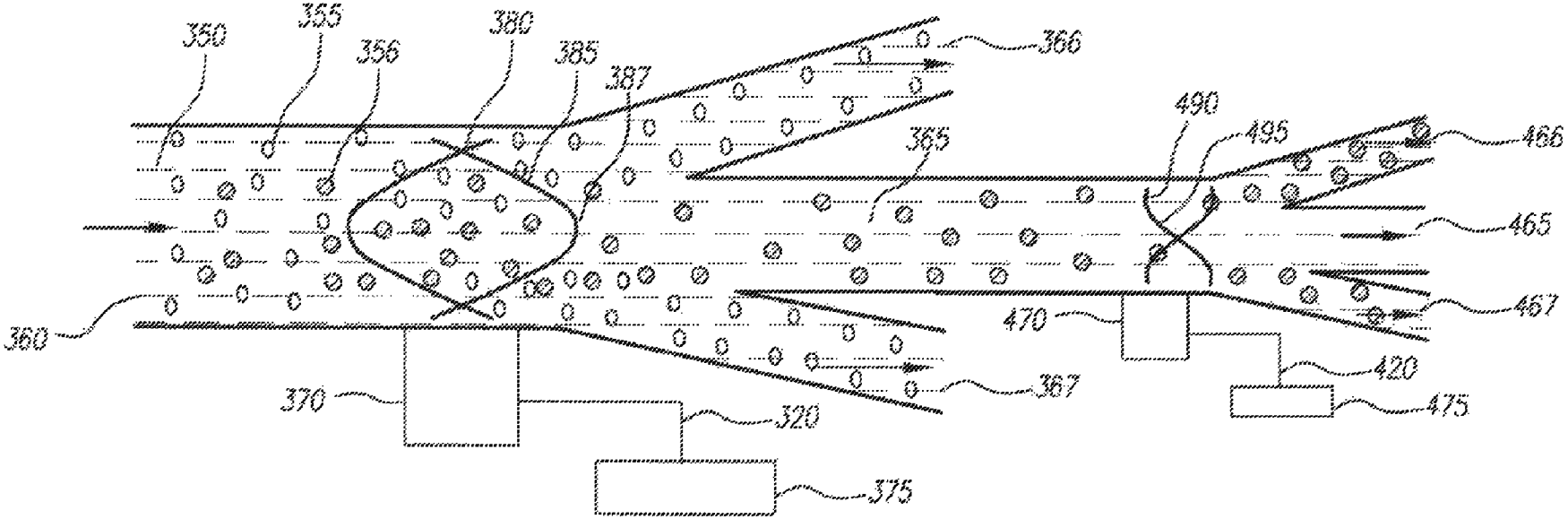
FIG. 4 is a schematic view of yet another embodiment of a stand-alone particle removal device.

It is also possible to remove two or more different types of solid particles based on differences in their compressibility and densities. FIG. 4 is an embodiment of a stand-alone particle cleaning apparatus. A liquid source 350 containing two types of particles, particles 355 and particles 356, is provided through an inlet 360 to first stage outlets 365, 366 and 367, and then second stage outlets 465, 466 and 467. A first stage acoustic resonator 370 is controlled by a first stage controller 375 to form a standing wave 385 with nodes 380 along the direction transverse to the liquid flow direction. The standing wave causes the particles 355 with positive $\phi$ value to move toward the nodes 380, and the particles 356 with negative $\phi$ value to move toward the antinodes 387. Therefore, the particles 355 follow the liquid flow into outlet 366 and 367, and are removed from the liquid flow in the first stage outlet 365. The particles 356 follow the liquid flow into first stage outlet 365. Along the first stage outlet 365, a second acoustic resonator 470 is controlled by a controller 475 to form a standing wave 495 with antinodes 490 along the direction transverse to the liquid flow direction. The standing wave 495 causes the particles 356 with negative $\phi$ value to move toward the antinodes 490. Therefore, the particles 356 follow the liquid flow into outlet 466 and 467, and are removed from the liquid flow in the second outlet 465. Therefore, the flow in outlet 465 contains no particles 355 or particles 356.

The acoustic resonator in the present invention may be various acoustic resonators available commercially. The acoustic resonator may be a piezoelectric resonator that is an electrically excitable and mechanically oscillating element. This enables the application of sound to the dispersion medium without any difficulties. Particularly suitable are piezoceramics with a highly effective piezocoefficient, such as lead zirconate-titanate.

A piezoelectric resonator works on the principle of piezoelectricity. Piezoelectricity is the ability of crystals and certain ceramic materials to generate a voltage in response to applied mechanical stress. The piezoelectric effect is reversible in that piezoelectric crystals, when subjected to an externally applied voltage, can change shape by a small amount. For example, the deformation is about 0.1% of the original dimension in PZT. The effect finds useful applications such as the production and detection of sound, generation of high voltages, electronic frequency generation, microbalance, and ultra fine focusing of optical assemblies. A break through was made in the 1940's when scientists discovered that barium titanate could be bestowed with piezoelectric properties by exposing it to an electric field.

Piezoelectric materials are used to convert electrical energy to mechanical energy and vice-versa. The precise motion that results when an electric potential is applied to a piezoelectric material is of primordial importance for nanopositioning. Resonators using the piezo effect are commercially available. Piezo resonators can perform sub-nanometer moves at high frequencies because they derive their motion from solid-state crystalline effects. They have no rotating or sliding parts to cause friction. Piezo resonators can move high loads, up to several tons. Piezo resonators present capacitive loads and dissipate virtually no power in static operation. Piezo resonators require no maintenance and are not subject to wear because they have no moving parts in the classical sense of the term.

The above embodiments are limited to printheads. They find applications with any liquid source in which particle removal is necessary. For inkjet printing, the liquid source can be a printhead and ink outlet can be a nozzle. If the ink outlet is a nozzle, the particles typically have a size that is substantially comparable to the size of the nozzle.

The invention has been described in detail with particular reference to certain preferred embodiments thereof, but it will be understood that variations and modifications can be effected within the scope of the invention.

PARTS LIST

1 subscripts
2 subscripts
4 liquid flow
5 particles
6 flow direction
7 standing wave
8 x-y coordinate system
9 nodes
10 antinodes
11 inkjet printhead
12 liquid droplets
14 nozzle plate
16 acoustic resonator
18 controller
20 conductive path
30 nozzle openings
32 ink recycling mechanism
34 standing wave
35 pressure antinodes
36 pressure nodes
37 pressure node
38 pressure nodes
40 liquid flow direction
150 liquid source
155 particles
160 inlet
165 outlets
166 outlet
167 outlets
170 acoustic resonator
175 controller
180 nodes
185 standing wave
250 liquid source
255 particles
260 inlet
265 outlets
266 outlets
267 outlets
270 acoustic resonator
275 controller
280 antinodes
285 standing wave
350 liquid source
355 particles
356 particles
360 inlet
365 first stage outlets
366 first stage outlets
367 first stage outlets
370 first stage acoustic resonator
375 first stage controller
380 nodes
385 standing wave
387 antinodes
465 second stage outlets
466 second stage outlets
467 second stage outlets
470 second acoustic resonator
475 controller
490 antinodes
495 standing wave

The invention claimed is:

1. A method of operating a printing system comprising:

providing a liquid source including a liquid, the liquid including particles, the liquid source including an outlet;

providing an acoustic transducer associated with the liquid source;

actuating the acoustic transducer using a controller to generate a standing sound wave including a nodal point in the liquid such that the particles are caused to move toward the nodal point of the standing sound wave;

using the nodal point of the standing sound wave to direct the particles toward the outlet of the liquid source; and changing the location of the nodal point to direct the particles to another area within the liquid source.

2. The method of claim 1, wherein liquid source is a printhead and the outlet is a nozzle.

3. The method of claim 1, wherein changing the location of the nodal point to direct the particles to another area within the liquid source includes directing the particles to another outlet of the liquid source.

4. The method of claim 1, wherein the outlet of the liquid source is in liquid communication with at least one of a filter and a liquid recycling system.

5. The method of claim 1, wherein actuating the acoustic transducer to generate the standing sound wave including the nodal point includes actuating the acoustic transducer during at least one of a start up, maintenance, and printing operation of the printing system.

6. The method of claim 1, the liquid including a pigment having a pigment particle size, the particles having a size, wherein the size of the particles is greater than the particle size of the pigment.

7. The method of claim 1, the liquid source being a liquid tank, further comprising:

providing a printhead connected in liquid communication to the liquid tank.

8. A printing system comprising:

a liquid source including a liquid, the liquid including particles, the liquid source including an outlet;

an acoustic transducer associated with the liquid source; and a controller operably associated with the acoustic transducer, the controller being configured to actuate the acoustic transducer to generate a standing sound wave including a nodal point in the liquid such that the particles are caused to move toward the nodal point of the standing sound wave, the nodal point being positioned to direct the particles toward the outlet of the liquid source, and wherein the controller is configured to change the location of the nodal point to direct the particles to another outlet of the liquid source.

9. The system of claim 8, wherein the liquid source is a printhead and the outlet is a nozzle.

10. The system of claim 8, wherein the liquid source is a liquid supply line and the outlets are outlets of the liquid supply line.

11. The system of claim 8, further comprising:

at least one of a filter and a liquid recycling system in liquid communication with the outlet of the liquid source.

12. The system of claim 11, wherein the liquid recycling system is configured to remove the particles from the liquid and return the liquid to the liquid source.

13. The system of claim 8, the liquid source being a liquid storage tank, further comprising:

a printhead in liquid communication with the liquid storage tank.

14. A method of operating a printing system comprising:

providing a liquid source of liquid including a liquid, the liquid including particles, the liquid source including an outlet;

providing a pressure generating mechanism associated with the liquid source;

actuating the pressure generating mechanism using a controller to generate a region of high pressure and a region of low pressure in the liquid that are transparent to the liquid and that cause particles in the liquid to move from the region of high pressure toward the region of low pressure to direct the particles toward the outlet of the liquid source; and changing the location of the region of high pressure and the region of low pressure in the liquid to direct the particles to another outlet of the liquid source.

* * * * *